US007551864B2

(12) United States Patent
Fujimori et al.

(10) Patent No.: US 7,551,864 B2
(45) Date of Patent: Jun. 23, 2009

(54) IMAGE FORMING APPARATUS AND METHOD OF CONTROLLING AN IMAGE QUALITY

(75) Inventors: Kohta Fujimori, Yokohama (JP); Yuushi Hirayama, Sagamihara (JP); Shinji Kato, Kawasaki (JP); Nobutaka Takeuchi, Yokohama (JP); Kayoko Tanaka, Tokyo (JP); Kazumi Kobayashi, Tokyo (JP); Shin Hasegawa, Zama (JP); Takashi Enami, Chigasaki (JP); Kiichirou Shimizu, Fujisawa (JP)

(73) Assignee: Ricoh Company, Ltd., Tokyo (JP)

( * ) Notice: Subject to any disclaimer, the term of this patent is extended or adjusted under 35 U.S.C. 154(b) by 406 days.

(21) Appl. No.: 11/564,677

(22) Filed: Nov. 29, 2006

(65) Prior Publication Data

US 2007/0122171 A1 May 31, 2007

(30) Foreign Application Priority Data

Nov. 29, 2005 (JP) ..... 2005-344279

(51) Int. Cl.
*G03G 15/00* (2006.01)
*G03G 15/01* (2006.01)

(52) U.S. Cl. ..... 399/38; 399/49; 399/72; 399/301

(58) Field of Classification Search ..... 399/38, 399/49, 72, 301, 302
See application file for complete search history.

(56) References Cited

U.S. PATENT DOCUMENTS 5,198,861 A 3/1993 Hasegawa et al.
5,475,476 A 12/1995 Murai et al.
5,682,572 A 10/1997 Murai et al.
5,857,131 A 1/1999 Hasegawa
6,160,569 A 12/2000 Fujimori et al.
6,175,700 B1 * 1/2001 Miller et al. ..... 399/72
6,594,453 B2 7/2003 Kato (Continued)

FOREIGN PATENT DOCUMENTS

JP 2003-167394 6/2003

OTHER PUBLICATIONS

U.S. Appl. No. 11/856,304, filed Sep. 17, 2007, Oshige, et al.

(Continued)

*Primary Examiner*—Hoang Ngo
(74) *Attorney, Agent, or Firm*—Oblon, Spivak, McClelland, Maier & Neustadt, P.C.

(57) ABSTRACT

An image forming apparatus includes an image bearing member, an image forming mechanism configured to perform an image formation by performing a first image forming operation to form a first image on the image bearing member and an image transferring operation to transfer the first image onto a recording member, and an image quality controlling mechanism configured to perform an image control by performing a second image forming operation to form a second image on the image bearing member and an image controlling operation to control an image quality according to the second image. The image quality controlling mechanism determines an operation condition of starting the image control according to first information of operations during the image formation and second information of operations during the image control, when the second image forming operation is performed during the first image forming operation.

20 Claims, 6 Drawing Sheets

U.S. PATENT DOCUMENTS

| | | | | |
|---|---|---|---|---|
| 6,804,479 | B2 * | 10/2004 | Kimura | 399/49 |
| 7,062,185 | B2 | 6/2006 | Izumikawa et al. | |
| 2005/0019048 | A1 | 1/2005 | Kato | |
| 2005/0147424 | A1 | 7/2005 | Kato et al. | |
| 2005/0207766 | A1 | 9/2005 | Hasegawa et al. | |
| 2007/0122171 | A1 | 5/2007 | Fujimori et al. | |

OTHER PUBLICATIONS

U.S. Appl. No. 11/932,198, filed Oct. 31, 2007, Takeuchi, et al.
U.S. Appl. No. 12/112,525, filed Apr. 30, 2008, Koizumi et al.
U.S. Appl. No. 12/093,753, filed May 15, 2008, Oshige et al.
U.S. Appl. No. 12/094,198, filed May 19, 2008, Kato et al.

* cited by examiner

IMAGE FORMING APPARATUS AND METHOD OF CONTROLLING AN IMAGE QUALITY

CROSS REFERENCE TO RELATED APPLICATIONS

The present application claims priority to Japanese patent application no. 2005-344279, filed in the Japan Patent Office on Nov. 29, 2005, the disclosure of which is incorporated by reference herein in its entirety.

BACKGROUND OF THE INVENTION

1. Field of the Invention

The present invention relates to an image forming apparatus including an image controlling unit, and a method of controlling an image quality.

2. Description of the Related Art

A related art image forming apparatus performs an image control in an image quality controlling mode. In the image quality control mode, an image controller of the related art image forming apparatus causes an optical writing unit to form test patterns on a surface of an image bearing member. An image density sensor of the related art image forming apparatus detects the image density of the test pattern so that the controller can control an image quality based on the detection result.

The image control is required to be performed at predetermined intervals, so the related art image forming apparatus performs the image control during a standby state until the power of the related art image forming apparatus is turned on or during an image forming operation at the timings of the predetermined intervals.

When the image control is performed during an image forming operation, test patterns are formed in an area or areas outside of an image forming area on the surface of an image bearing member so as to be used for detecting the density of the patterns. By performing the image control during the image forming operation, the related art image forming apparatus can reduce a system stopping time thereof.

However, areas that are located outside of an image forming area for forming test patterns have recently been reduced, and technologies for image control are becoming more accurate. For these reasons, it has become more difficult to form test patterns on such areas of the image bearing member during the image forming operation. The recent image controls, therefore, are performed while the related art image forming apparatus has stopped or interrupted the image forming operations.

When interrupting the image forming operations of the related art image forming apparatus, the previously performed image forming operations are required to be stopped in an orderly manner before starting the image controls. At the same time, a photoconductive element drive unit, a transfer member drive unit, and so forth are stopped. When the related art image forming apparatus employs an optical writing unit, a polygon motor drive unit and so forth are required to be stopped to stop the operations for image forming, and then it is required to reboot the operations for image control.

The above-described sequential operations are generally performed, because an adverse effect such as damage may be lessened to the related art image forming apparatus and the above-described drive units may have less complicated respective structures and functions. The above-described sequential operations, however, need to be stopped then it is required to reboot the above-described drive units, and that may cause the system stopping time to become longer.

To avoid the long system stopping time, there are some techniques that can form test patterns for image control while the related art image forming apparatus is interrupting the image forming operations without stopping the drive units of the related art image forming apparatus.

One technique provides a first method in which the image control is performed with the presently used image forming condition for the image forming operation.

Another technique provides a second method in which the image control is performed after changing the presently used image forming condition for the image forming operation to a test pattern forming condition for the image control, when these conditions are not identical.

In the first method, an image density control for determining an exposing condition and a development potential condition may be identical to the density detecting condition of the test pattern for the image control and the image forming condition for the image forming operation. Therefore, when the result data of the image control is applied to the image forming condition at a different linear velocity, it is required to correct the result data according to the conditions previously determined by each linear velocity or to detect respective densities of the test patterns for image control by each linear velocity.

However, when the result is corrected according to each of the previously determined conditions by each linear velocity, various corrections may be performed. For example, the various corrections are performed when the result of the image control with a low linear velocity is applied to the image forming condition with a high linear velocity or when the result of the image control with a high linear velocity is applied to the image forming condition with a low linear velocity. The various corrections of the former case are not always identically reversed to those of the latter case, and accumulated errors may arise in these cases.

Further, when the various corrections are used to control the image quality according to each linear velocity, the system stopping time for the image control may become long.

Furthermore, when the related art image forming apparatus has a separation mechanism in which photoconductive members other than a black image photoconductive element are separated from a transfer member when forming a black-and-white image, the image control may be performed two times. That is, the image control is performed for the black-and-white image while the separation mechanism separates the photoconductive elements other than the black image photoconductive element, and the image control is performed for the cyan, magenta, and yellow images while the separation mechanism causes contact of the photoconductive elements.

On the other hand, in the second method, when the drive units drive the respective units at different speeds for the image forming operation and the image control, the speeds may be changed when switching the operations between the image forming operation and the image control. When the speed is changed, a load may be given to the units in contact with each other. For example, such a load may be given to a cleaning blade and an image bearing member disposed in contact with each other. The load may also be given to each photoconductive element and a transfer belt in contact with each other. This can cause damage to and/or deterioration in the related art image forming apparatus.

Further, for the adjustments of image density sensors and image shift sensors, the image bearing members that include the photoconductive elements and the transfer belt may be rotated with the toner patterns thereon, and the image density sensors and the image shift sensors may detect and obtain data of the reflectivity of the toner patterns on the photoconductive elements and the transfer belt.

Unfortunately, the image bearing member and the transfer belt can be damaged due to abrasion and scratches, and thereby the reflectivity on the respective surfaces thereof may become uneven. Therefore, when the reflectivity is measured at a small portion of each surface of the photoconductive elements and the transfer belt, the result of the reflectivity may greatly differ from the actual reflectivity of an entire surface thereof. This can decrease the level of accuracy in detection by the sensors. For the above-described reasons, the reflectivity of the toner patterns formed on the photoconductive elements and the transfer member may be measured in a wide range of the areas, which may need a long time for measuring.

SUMMARY OF THE INVENTION

Exemplary aspects of the present invention have been made in view of the above-described circumstances.

Exemplary aspects of the present invention provide a novel image forming apparatus that can perform an image control using an image controlling mechanism included therein.

Other exemplary aspects of the present invention provide a novel method of controlling an image quality by the image controlling mechanism included in the image forming apparatus.

In one exemplary embodiment, a novel image forming apparatus includes an image bearing member, an image forming mechanism configured to perform an image formation by performing a first image forming operation to form a first image on a surface of the image bearing member and an image transferring operation to transfer the first image onto a recording member, and an image quality controlling mechanism configured to perform an image control by performing a second image forming operation to form a second image on the surface of the image bearing member and an image controlling operation to control an image quality according to the second image. The image quality controlling mechanism determines an operation condition of starting the image control according to first information of operations during the image formation by the image forming mechanism and second information of operations during the image control by the image quality controlling mechanism, when the second image forming operation is performed during the first image forming operation.

The first information and the second information may include respective linear velocities of the image bearing member during the image formation and the image control.

The image bearing member may include a plurality of primary image bearing members, each of which is configured to bear one of the first and second images, and a secondary image bearing member configured to receive the one of the first and second images from the plurality of primary image bearing members. The first and second image forming operations may include a first image forming condition in which one of the plurality of primary image bearing members is held in contact with the secondary image bearing member, and a second image forming condition in which the plurality of primary image bearing members are held in contact with the secondary image bearing member. The first information of operations during the image formation by the image forming mechanism and the second information of operations during the image control by the image quality controlling mechanism may include information as a result of determining whether each of the image formation and the image control is performed with the first or second image forming condition.

The image quality controlling mechanism may perform the image control at a predetermined single linear velocity of the image bearing member.

The image quality controlling mechanism may perform the image control at a fastest linear velocity in the image forming apparatus.

The image quality controlling mechanism may perform the image control at a most frequently used linear velocity of the image forming apparatus.

The image quality controlling mechanism may perform the image control under the second image forming condition.

The image control may include an image density control and an image shift adjustment, the image quality controlling mechanism performs at least one of the image density control and the image shift adjustment, and image density control is started before the image shift adjustment.

The image quality controlling mechanism may further determine the operation condition of starting the image control according to the first information, the second information, and third information of a type of the image control.

The above-described novel image forming apparatus may further include a sensor configured to detect the second image.

The image quality controlling mechanism may perform an adjustment of the sensor, the image control may include an image density control and an image shift adjustment, the sensor may perform one of the image density control and the image shift adjustment, and the third information may include information indicating that the adjustment of the sensor is performed.

Further, in another exemplary embodiment, a novel method of controlling an image quality includes performing an image formation by forming a first image on an image bearing member, performing an image control by forming a second image on the image bearing, and determining an operation condition of starting the image control according to first information of operations during the image formation and second information of operations during the image control, when the image control is performed during the image formation.

The determining may further include determining an execution timing of an image control, determining a type of the image control, determining at least one printing mode, and determining the operation condition of starting the image control.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
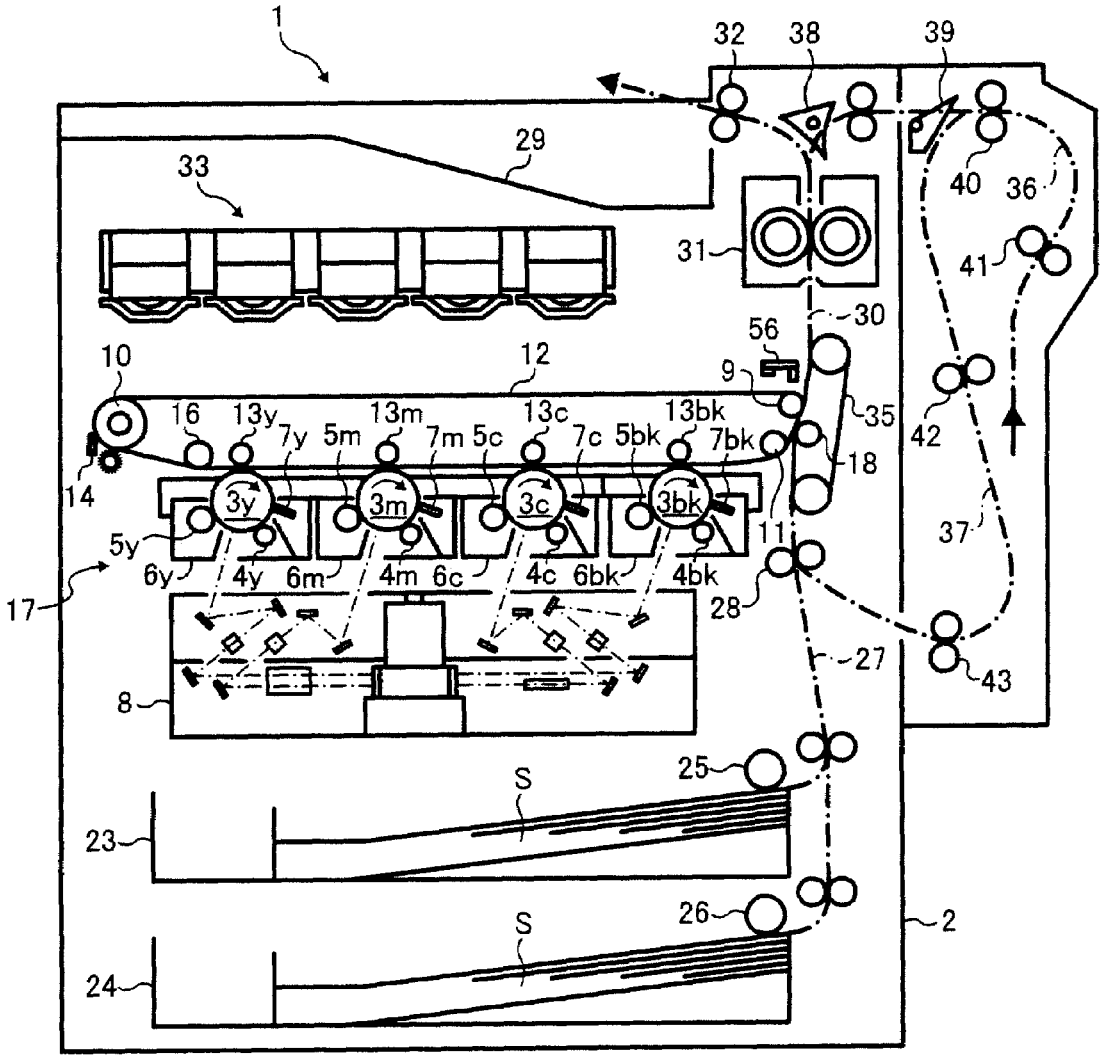
FIG. 1 is a schematic structure of a color printer according to one exemplary embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present invention are described.

Referring to FIG. 1, a color printer 1 according to one exemplary embodiment of the present invention is described.

The color printer 1 serves as a tandem-type full-color image forming apparatus that uses a two-component developer and that employs an electrophotographic system.

The color printer 1 includes a main body 2 and drum shaped photoconductive elements 3*y*, 3*m*, 3*c*, and 3*bk*.

The drum shaped photoconductive elements 3*y*, 3*m*, 3*c*, and 3*bk* serve as image bearing members and are disposed at the approximately center portion of the main body 2. The drum shaped photoconductive elements 3*y*, 3*m*, 3*c*, and 3*bk* are separately arranged at a horizontal position with respect to the color printer 1. The reference letters, "y", "m", c and "bk", stand for yellow, magenta, cyan, and black colors, respectively.

The drum shaped photoconductive elements 3*y*, 3*m*, 3*c* and 3*bk* have similar structures and functions, except that respective toners are of different colors, which are yellow, magenta, cyan, and black toners. Therefore, the explanations below focus on the operations performed by the photoconductive element 3*y* as exemplary.

The photoconductive element 3*y* serves as an image bearing member for producing a yellow toner image. The photoconductive element 3*y* includes, e.g., an aluminum cylindrical member and an organic semiconductor layer and is driven by a photoconductive element drive motor (not shown) in a clockwise direction as indicated by an arrow in FIG. 1.

The aluminum cylindrical member serves as a core material having a diameter in a range from approximately 30 mm to approximately 100 mm.

The organic semiconductor layer of the photoconductive element 3*y* may include a photoconductive material and may be mounted on a surface of the aluminum cylindrical member.

The photoconductive element 3*y* is surrounded by image forming components, such as a charging unit 4*y*, a developing unit 6*y*, and a drum cleaning unit 7*y*, which arranged in the sequential order of an electrostatic image forming process.

The charging unit 4*y* includes a charging roller and uniformly charges the surface of the photoconductive element 3*y*.

The developing unit 6*y* includes a developing roller 5*y* and develops an electrostatic latent image formed on the surface of the photoconductive element 3*y* into a visible toner image.

The drum cleaning unit 7*y* removes residual toner or foreign materials from the surface of the photoconductive element 3*y* after the toner image has been transferred.

As previously described, the photoconductive elements 3*y*, 3*m*, 3*c*, and 3*bk* have similar structures and functions, and the photoconductive elements 3*m*, 3*c*, and 3*bk* for producing magenta, cyan, and black toner images, respectively, may have respective image forming components therearound and may be rotated by respective photoconductive element drive motors (not shown), respectively, in a clockwise direction or in a direction indicated by an arrow shown in FIG. 1.

Specifically, the respective image forming components disposed around the photoconductive elements 3*m*, 3*c*, and 3*bk* are charging units 4*m*, 4*c*, and 4*bk*, developing units 6*m*, 6*c*, and 6*bk* including developing rollers 5*m*, 5*c*, and 5*bk*, and cleaning units 7*m*, 7*c*, and 7*bk* in a same manner as the image forming components disposed around the photoconductive element 3*y*.

The developing units 6*y*, 6*m*, 6*c*, and 6*bk* include respective two-component developers having yellow, magenta, cyan, and black toners, respectively.

As previously described, each of the photoconductive elements 3*y*, 3*m*, 3*c*, and 3*bk* in the color printer 1 according to the exemplary embodiment of the present invention is in a drum shape. However, the shape of each photoconductive element is not so limited but can be formed in a different shape. For example, the photoconductive elements 3*y*, 3*m*, 3*c*, and 3*bk* can be formed in a belt shape.

Further, the photoconductive elements 3*y*, 3*m*, 3*c*, and 3*bk* and the image forming components may be mounted as respective image forming units of an image forming mechanism 17.

The color printer 1 further includes an optical writing unit 8, a plurality of supporting rollers 9, 10, 11, and 16, an intermediate transfer belt 12, primary transfer rollers 13*y*, 13*m*, 13*c*, and 13*bk*, a belt cleaning unit 14, a secondary transfer roller 18, sheet feeding cassettes 23 and 24, sheet feeding rollers 25 and 26, a sheet conveying path 27, a pair of registration rollers 28, a sheet stacker 29, a sheet discharging path 30, a fixing unit 31, a pair of sheet discharging rollers 32, a toner container 33, and a sheet conveying belt 35.

The optical writing unit 8 is disposed below the photoconductive elements 3*y*, 3*m*, 3*c*, and 3*bk*. The optical writing unit 8 emits respective laser light beams modulated according to image data of each color to the respective surfaces of the photoconductive elements 3*y*, 3*m*, 3*c*, and 3*bk* and irradiates the respective surfaces of the photoconductive elements 3*y*, 3*m*, 3*c*, and 3*bk* so that respective electrostatic latent images can be formed on the respective surfaces of the photoconductive elements 3*y*, 3*m*, 3*c*, and 3*bk*. Respective long openings or slits are formed between the charging roller 4*y* and the developing roller 5*y*, between the charging roller 4*m* and the developing roller 5*m*, between the charging roller 4*c* and the developing roller 5*c*, and between the charging roller 4*bk* and the developing roller 5*bk*, so that the respective laser light beams can travel therethrough toward the respective photoconductive elements 3*y*, 3*m*, 3*c*, and 3*bk*.

In the exemplary embodiment of the present invention, the optical writing unit 8 employs a laser scanning system with semiconductor lasers, a polygon mirror, and other optical components. However, the optical writing unit is not limited to such a system. For example, the present invention can alternatively apply an optical writing unit that employs a system in combination of LED array and image forming units or components.

The intermediate transfer belt 12 is disposed above the photoconductive elements 3*y*, 3*m*, 3*c*, and 3*bk*. The intermediate transfer belt 12 serves as an image bearing member or an intermediate transfer member. The intermediate transfer belt 12 forms an endless belt supported by or spanned around the plurality of supporting rollers 9, 10, 11, and 16. The intermediate transfer belt 12 is rotated in a counterclockwise direction and is arranged in a substantially horizontal manner so as to be held in contact with the photoconductive elements 3*y*, 3*m*, 3*c*, and 3*bk*. The intermediate transfer belt 12 has an inner surface with which the primary transfer rollers 13*y*, 13*m*, 13*c*, and 13*bk* are held in contact, see also FIG. 5 for an enlarged view.

The intermediate transfer belt 12 may include a base member formed by a resin film or a rubber and have a thickness of approximately 50 μm to approximately 600 μm. The intermediate transfer belt 12 may also have resistivity for receiving toner images from the photoconductive elements 3*y*, 3*m*, 3*c*, and 3*bk*.

The primary transfer rollers 13*y*, 13*m*, 13*c*, and 13*bk* are arranged to face the photoconductive elements 3*y*, 3*m*, 3*c*, and 3*bk*, respectively, sandwiching the intermediate transfer belt 12 so that respective primary transfer nips may be formed between the primary transfer rollers 13*y*, 13*m*, 13*c*, and 13*bk* and the photoconductive elements 3*y*, 3*m*, 3*c*, and 3*bk*, respectively.

The belt cleaning unit 14 is disposed in contact with an outer surface of the intermediate transfer belt 12, opposite to the supporting roller 10. The belt cleaning unit 14 removes residual toner remaining on the surface of the intermediate transfer belt 12.

The sheet feeding cassettes 23 and 24 are disposed below the optical writing unit 8 in the main body 2 of the color printer 1. The sheet feeding cassettes 23 and 24 include sheet feeding rollers 25 and 26, respectively, which separately accommodate recording media. A recording sheet S among the recording media is selectively fed by one of the sheet feeding rollers 25 and 26 from the corresponding one of the sheet feeding cassettes 23 and 24.

The sheet conveying belt 35 forms an endless loop and includes the secondary transfer roller 18 in contact with its inner surface.

The secondary transfer roller 18 serves as a secondary transferring member and is arranged to face the supporting roller 9 in contact with the intermediate transfer belt 12. The secondary transfer roller 18 and the supporting roller 9 sandwich the intermediate transfer belt 12 and the sheet conveying belt 35 so as to form a secondary transfer nip.

The sheet conveying path 27 is formed in a substantially vertical direction toward the secondary transfer nip formed between the intermediate transfer belt 12 and the secondary transfer roller 18.

The pair of registration rollers 28 is disposed immediately downstream of the secondary transfer nip in the sheet conveying path 27. The pair of registration rollers 28 stops and feeds the recording sheet S in synchronization with a movement of the intermediate transfer belt 12.

The sheet discharging path 30 is formed above the secondary transfer nip. The sheet discharging path 30 takes over the sheet conveying path 27 from the secondary transfer nip via the fixing unit 31 and via the pair of sheet discharging rollers 32 toward the sheet stacker 29.

The sheet stacker 29 is located at the upper portion of the main body 2 of the color printer 1 and receives a stack of sheets output from the main body 2 of the color printer 1.

The fixing unit 31 includes a pair of fixing rollers to fix a toner image to a recording sheet by applying heat and pressure.

The pair of sheet discharging rollers 32 conveys the fixed recording sheet to the sheet stacker 29.

The toner container 33 is disposed in the main body 2 below the sheet stacker 29 and accommodates respective toners having different colors so that the respective toners can be supplied to the developing units 6*y*, 6*m*, 6*c*, and 6*bk* via a pump unit (not shown).

Image forming operations performed by the above-described color printer 1 are now described.

For forming a yellow toner image, the photoconductive element drive motor (not shown) for driving the photoconductive element 3*y* rotates the photoconductive element 3*y*. The charging unit 4*y* applied with a charging bias uniformly charges the surface of the photoconductive element 3*y*. The optical writing unit 8 emits a laser light beam generated by a semiconductor laser writing member (not shown) and irradiates the surface of the photoconductive element 3*y*. This can form an electrostatic latent image according to image data for a yellow toner image on the surface of the photoconductive element 3*y*. The developing unit 6*y* develops the electrostatic latent image to the yellow toner image.

The primary transfer roller 13*y* is applied with a transfer bias from a power source for the primary transfer and is driven by a primary transfer belt drive motor (not shown) that forms a primary transfer belt drive (not shown). Thus, the yellow toner image is transferred from the photoconductive element 3*y* onto the intermediate transfer belt 12 that moves in synchronization with a movement of the photoconductive element 3*y*.

For forming magenta, cyan, and black toner images, the image forming units of the image forming mechanism 17 including the photoconductive elements 3*m*, 3*c*, and 3*bk* operate in a same manner as the image forming units of the image forming mechanism 17 for forming the yellow toner image.

The primary transfer rollers 13*m*, 13*c*, and 13*bk* are applied with respective transfer biases so that the magenta, cyan, and black toner images are transferred onto the surface of the intermediate transfer belt 12 by sequentially overlaying on the yellow toner image. Thereby, a full color toner image can be formed on the intermediate transfer belt 12. The intermediate transfer belt 12 then carries and conveys the full color toner image.

After the respective toner images are transferred onto the intermediate transfer belt 12, the drum cleaning units 7*y*, 7*m*, 7*c*, and 7*bk* remove residual toners on the photoconductive elements 3*y*, 3*m*, 3*c*, and 3*bk*.

While the above-described image forming units of the image forming mechanism 17 in the color printer 1 perform the image forming operations, the recording sheet S is selectively fed from one of the sheet feeding cassettes 23 and 24 and is conveyed through the sheet conveying path 27 toward the pair of registration rollers 28. The pair of registration rollers 28 stops and feeds the recording sheet S in synchronization with the movement of the intermediate transfer belt 12 having the full color toner image on its surface thereof. When the recording sheet S is conveyed to the secondary transfer nip, the secondary transfer roller 18 applied with a transfer bias from a secondary transfer power source (not shown) attracts the full color toner image formed on the intermediate transfer belt 12 to the recording sheet S when the recording sheet S passes the secondary transfer nip. The recording sheet S is then conveyed to the fixing unit 31. After the full color image is fixed, the sheet discharging roller 32 conveys the recording sheet S to the sheet stacker 29.

The belt cleaning unit 14 removes residual toner on the surface of the intermediate transfer belt 12.

The above-described operation has described how the recording sheet S having a full color image on one side thereof is processed in a single image printing mode.

For printing images on both side of the recording sheet S, the color printer 1 performs the image forming operation in a duplex image printing mode.

The color printer 1 further includes a sheet reversing path 36, a sheet re-feeding path 37, separators 38 and 39, and a plurality of pairs of conveying rollers 40, 41, 42, and 43.

In the duplex image printing mode, the separator 38 guides the recording sheet S having a fixed full color image on one side thereof to the sheet reversing path 36. The recording sheet S is conveyed forward and backward by the pairs of sheet conveying rollers 40 and 41 so as to reverse the sides of the recording sheet S. Then, the separator 39 guides the recording sheet S to the pair of registration rollers 28 via the pairs of conveying rollers 42 and 43. The recording sheet S is then fed by the pair of registration rollers 28 to receive a different full color toner image on the other side thereof. After the other full color image is fixed by the fixing unit 31, the recording sheet S is discharged to the sheet stacker 29 by the pair of sheet discharging rollers 32.

Further, when a single color image is printed, a selected single photoconductive element and the related image forming components are operated while the other three photoconductive elements are not operated.

After the single color image is formed on the surface of the corresponding photoconductive element, that single color image is attracted by the corresponding primary transfer roller so that the single color image may be transferred onto the surface of the intermediate transfer belt 12. The single color image on the intermediate transfer belt 12 is further transferred onto the recording sheet S. The recording sheet S having the single color image thereon is fixed by the fixing unit 31, and is finally discharged by the pair of sheet discharging rollers 32 to the sheet stacker 29.

The color printer 1 further includes a sensor unit 56 in the main body 2 thereof. Details of the sensor unit 56 will be described later.

As described above, the color printer 1 may perform the above-described image forming operation. At the same time, the color printer 1 may perform an image controlling operation for controlling an image quality thereof.

Figure 2:
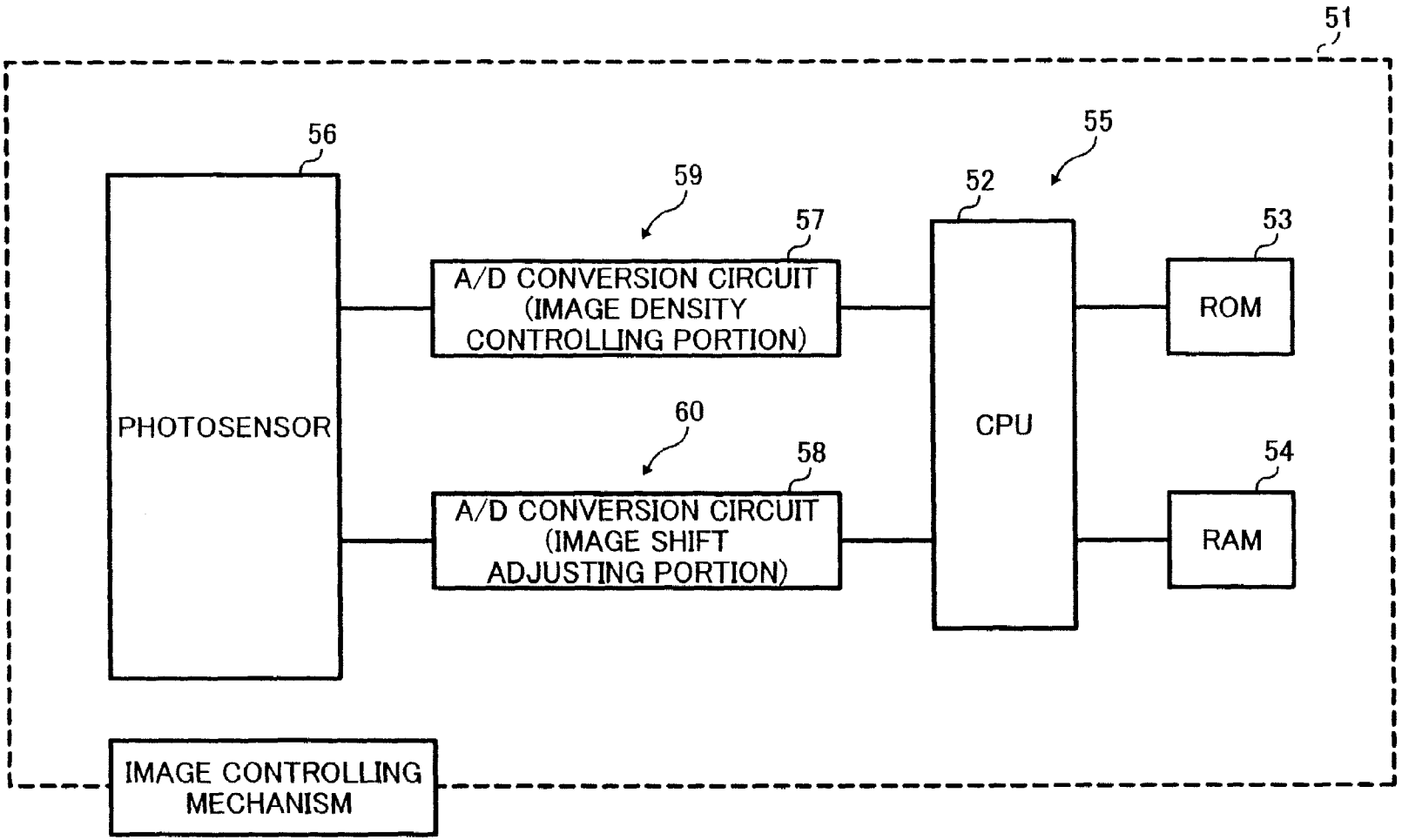
FIG. 2 is a schematic diagram of an image controlling unit of the color printer of FIG. 1, according to the exemplary embodiment of the present invention.

Referring to FIG. 2, a schematic diagram of an image controlling mechanism 51 according to one exemplary embodiment of the present invention is described.

The image controlling mechanism 51 shown in FIG. 2 serves as an image quality controlling system and performs an image control in the main body 2 of the color printer 1.

The image controlling mechanism 51 includes a controller 55, the photosensor unit 56 shown in FIG. 1, and first and second analog-to-digital or A/D converter circuits 57 and 58.

The controller 55 includes a central processing unit or CPU 52, a read only memory or ROM 53, and a random access memory or RAM 54. The RAM 54 may be a nonvolatile memory of the controller 55.

The photosensor unit 56 serves as a sensor unit for detecting an image density and an image shift of toner patterns formed on the surface of the intermediate transfer belt 12.

The photosensor unit 56, the first A/D converter circuit 57, and a part of the controller 55 may form an image density controlling portion 59. The photosensor unit 56, the second A/D converter circuit 58, and a part of the controller 55 may form an image shift adjusting portion 60.

Figure 3:
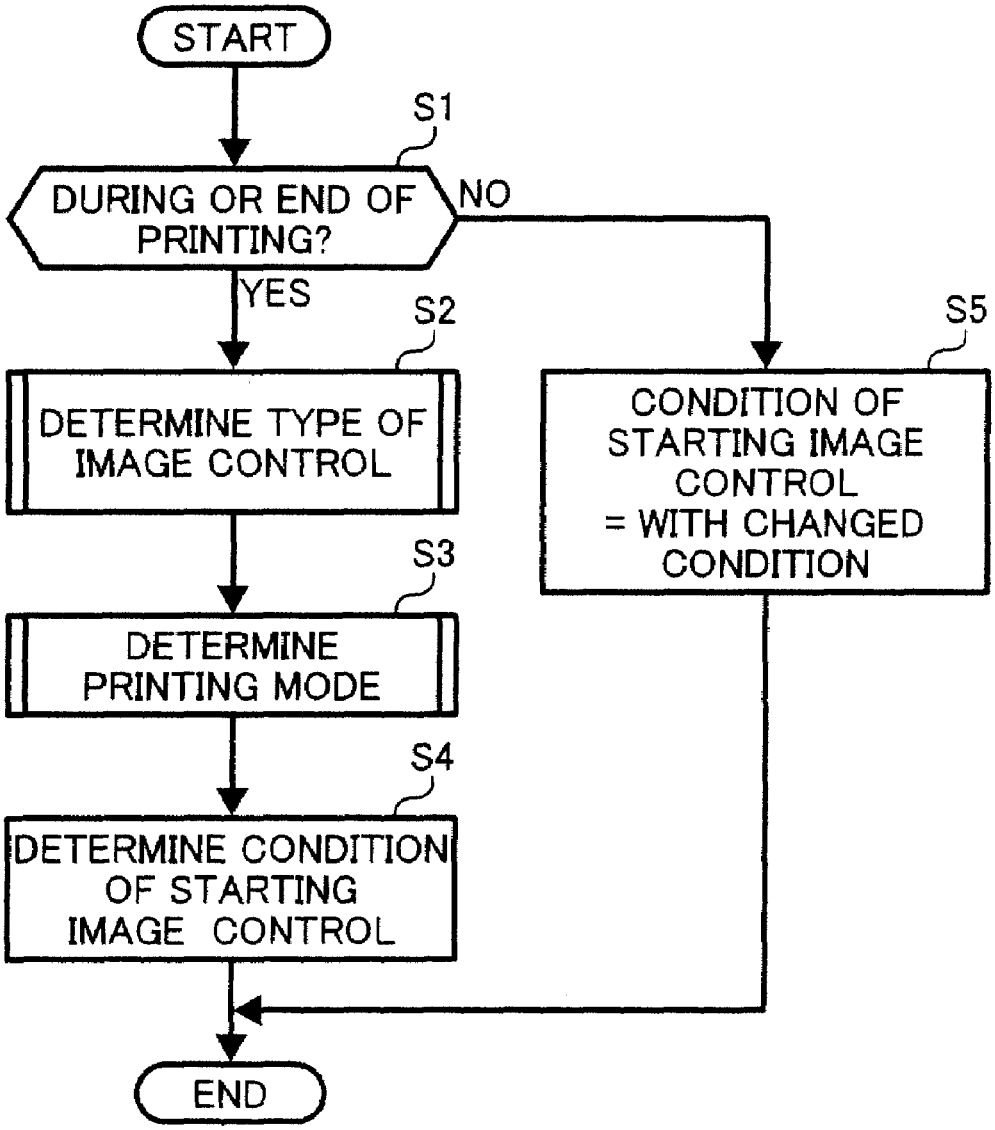
FIG. 3 is a flowchart of determining an operation condition of starting an image control performed in the color printer.

Referring to FIG. 3, a flowchart shows an operation procedure of determining an operation condition of starting an image control according to one exemplary embodiment of the present invention.

In step S1 of the flowchart in FIG. 3, the CPU 52 of the image controlling mechanism 51 may determine whether the execution timing of the image control is when the color printer 1 is in a state during or at the end of the image forming operation, which is a printing operation.

When the determination result of step S1 is YES, the execution timing of the image control is when the color printer 1 is in the state during or at the end of the image forming operation, and the process proceeds to step S2.

When the determination result of step S1 is NO, the execution timing of the image control is not when the color printer 1 is in the state during or at the end of the image forming operation, and the process proceeds to step S5.

In step S2 of the flowchart in FIG. 3, the CPU 52 may determine a type of image control to be performed, and the process proceeds to step S3. The "type of image control" may include two or more types of various image controls.

In step S3, the CPU 52 may determine printing modes to be performed, and the process proceeds to step S4.

In step S4, the CPU 52 may determine whether the operation condition of the image forming components corresponding to the image control is changed or not for starting of the image control.

In step S5, the CPU 52 may determine that the operation condition of the image forming components corresponding to the image control is changed for starting the image control.

After steps S4 or S5, the operations of determining the operation condition of starting the image control according to one exemplary embodiment of the present invention may be completed.

The following description is made to explain details of determining the operation condition of starting the image control.

The CPU 52 of the image controlling mechanism 51 may determine whether any image control needs to be performed at a predetermined timing.

In step S1, the "predetermined timing" may include execution timings of the image control, such as a timing at predetermined intervals during the printing operation and a timing at the end of the printing operation. However, the "predetermined timing" may further include other execution timings, such as a timing at a power on of the color printer 1, a timing when an instruction to start an image forming or printing operation is issued, a timing at predetermined intervals during the printing operation, a timing at the end of the printing operation, a timing at predetermined intervals during a print standby state, and so forth. For example, the "timing at predetermined intervals during the printing operation" may be a timing at the completion of printing 30 sheets, and the "timing at predetermined intervals during a print standby state" may be a timing when 30 minutes elapse after a photoconductive element has stopped.

The "image control" may include types of the image controls, such as an adjustment of the photosensor unit 56, an agitating operation of respective developers by the developing units 6*y*, 6*m*, 6*c*, and 6*bk*, an image density control performed by the image density controlling portion 59, an image shift adjustment performed by the image shift adjusting portion 60, a toner refreshing operation, a toner density controlling operation, and so forth. The execution timings and types of the image control may be "information" of operations during the image forming operation by the image forming mechanism 17 and during the image control by the image controlling mechanism 51.

In the exemplary embodiment, the description is mainly given for the image controls of the photosensor unit 56, the image density control by the image density controlling portion 59, and the image shift adjustment by the image shift adjusting portion 60.

The CPU 52 of the image controlling mechanism 51 may obtain data for determining whether any image control needs to be performed.

The "data" may include (1) the values of the present temperature and humidity detected by respective temperature and humidity sensors (not shown) provided in the color printer 1; the time measured by a time measuring unit; (2) the values of the temperature and humidity in the color printer 1, the time, and the counter value of the total number of printed pages at the previous stoppage of the photoconductive elements 3*y*, 3*m*, 3*c*, and 3*bk*; and (3) the values of the temperature and humidity in the color printer 1, the time, and the counter value of the total number of printed pages at the previous image control. The "counter value of the total number of printed pages" is a value obtained by a counter that counts a total number of printed pages.

Further, at the power on of the color printer 1, the CPU 52 may receive detection signals issued from a detecting unit (not shown) that can detect whether any image forming unit of the image forming mechanism 17 has been replaced since the previous printing operation of the color printer 1. Based on the result of the above-described detection, the CPU 52 may determine whether at least one of the image forming units has been replaced. The above-described detection result may be further included as a part of the data.

After obtaining the above-described data, the CPU 52 may check on various types of the image controls to determine whether these image controls need to be performed.

For example, the following operations describe the determination whether to perform the image density control.

The CPU 52 may determine a timing to perform the image density control according to the previously described timings, for example, the timing at the power on of the color printer 1, the timing at the end of the printing operation, and so forth.

After the determination of the timing, the CPU 52 may determine whether the image density control needs to be performed at the determined timing.

For example, when the determined timing is the timing at the power on of the color printer 1, the CPU 52 may calculate a system stopping period, which is a period between the previous time when the photoconductive elements 3*y*, 3*m*, 3*c*, and 3*bk* stopped their operations and the present time that has previously been obtained as the data. When the obtained system stopping period is greater than a predetermined period, the CPU 52 may determine that the image density control needs to be performed.

The "predetermined period" generally depends on an amount of density change during a period while the color printer 1, or the image forming apparatus according to the exemplary embodiment of the present invention, has been left in an unoperated state. In this case, the predetermined period can be set to 6 hours.

When the determined timing is the timing at predetermined intervals during or the timing at the end of the printing operation of the color printer 1, the CPU 52 may calculate the number of printed pages starting from the previous time when the image density control was performed. When the obtained number of printed pages is greater than the threshold of a predetermined number of printed pages, the CPU 52 may determine that the image density control needs to be performed.

In this case, the threshold of the predetermined number can be set to 200 pages or more.

Same as above, the CPU 52 may also determine whether the adjustment of the photosensor unit 56 and the image shift adjustment need to be performed according to respective characteristics thereof.

After the necessity of the entire image controls has been determined, the CPU 52 may determine the operation condition of starting the image control, based on the execution timing and type of the image controls.

When the operation condition of starting the image control is determined based on the type of the image controls, the operation condition of starting the image control may include first and second operation conditions.

The first operation condition may include operations of stopping and restarting various motors and biases for image forming, which is hereinafter referred to as an "image control in the changed operation condition."

The second operation condition may not include operations of stopping and restarting various motors and biases for image forming, which is hereinafter referred to as an "image control in the continuous operation condition."

The CPU 52 may determine whether the image control is performed in the changed operation condition or in the continuous operation condition, according to the following process.

When the image control is determined to be performed at the power on of the color printer 1, the CPU 52 may determine to perform the image control in the changed operation condition.

When the image control is determined to be performed during or at the end of the printing operation of the color printer 1, the determination of the operation condition of starting the image control may depend on other determinations of different parameters.

When (1) the image control is determined to be performed during or at the end of the printing operation of the color printer 1, (2) the adjustment of the photosensor unit 56 is needed, and (3) at least one of the image density control and the image shift adjustment is needed, the CPU 52 may determine to perform the image control in the changed operation condition.

However, when (1) the image control is determined to be performed during or at the end of the printing operation of the color printer 1, (2) the adjustment of the photosensor unit 56 is not needed, and when at least one of the image density control and the image shift adjustment is needed, the CPU 52 may determine to perform the image control in the continuous operation condition.

Thus, the CPU 52 may determine the operation condition of starting the image control. Specifically, the operation condition of starting the image control may be decided again according to, for example, the following printing modes when the image control is determined to be performed during or at the end of the printing operation of the color printer 1.

Next, the decisions of the operation condition of starting the image control when the image control is performed during the printing operation are now described.

When the printing operation is started and the request of the image control is issued, the CPU 52 may decide the operation condition of starting the image control.

In the printing process, the CPU 52 may determine a printing mode set of the next printing operation before printing each page of the present printing operation.

The "printing mode set" may include image forming modes, image quality modes, sheet type modes, and so forth. The "image forming modes" may include a full color mode, a monochrome mode in which only the image forming unit for black toner is operated, and so forth. The "image quality modes" may include a standard image quality mode, a high image quality mode, and so forth. The "sheet type modes", which is for handling a recording sheet S, may include a regular sheet mode, a thick paper mode, and so forth.

The above-described printing modes may be included into the "information" of operations during the image forming operation by the image forming mechanism 17 and during the image control by the image controlling mechanism 51.

When the printing mode set is determined, the CPU 52 may determine the operation condition of starting the image control as described below.

When (1) the printing mode set is set to a combination of the full color mode, the regular sheet mode, and the standard image quality mode, and (2) the operation condition of starting the image control that is determined based on the types of the image controls is set to the image control in the continuous operation condition, the CPU 52 may perform the image control in the continuous operation condition.

When the printing mode is set to a mode other than the combination of the full color mode, the regular sheet mode, and the standard image quality mode, the CPU 52 may perform the image control in the changed operation condition.

The decision, which is made by the CPU 52 for the operation condition of starting the image control between the image control in the changed operation condition and the image control in the continuous operation condition, may be focused on effectiveness to the color printer 1. That is, the decision may be focused on which type of the image controls may give no or less damage to the color printer 1 when the image forming operation is switched to the printing operation, and on which type of the image controls may have a shorter period of the user waiting time.

Further, as previously described, the CPU 52 may decide the operation condition of starting the image control again according to the printing modes during the printing operation, even when the operation condition of starting the image control has already been determined according to the execution timing and type of the image controls.

Specifically, when all the determinations are made to perform the image control in the continuous operation condition, the CPU 52 may perform the image control in the continuous operation condition. When at least one of the determinations is made to perform the image control in the changed operation condition, the CPU may perform the image control in the changed operation condition.

The CPU 52 may also perform the above-described operations to decide the operation condition of starting the image control to be performed at the end of the printing operation.

Next, operations for executing the image control in the continuous operation condition during the printing operation are described.

After a printer controller (not shown) has issued print instructions, the CPU 52 may initiate the printing operation.

A print controlling unit (not shown) may be included in the image forming mechanism 17. The print controlling unit may receive instructions of the initiation of the printing operation from the CPU 52. The print controlling unit may then turn on a polygon control drive to drive a polygon motor (not shown) so as to rotate a polygon mirror (not shown) mounted on the optical writing unit 8. When the polygon motor reaches a steady rotation state, the print controlling unit may turn on respective drive units to drive the photoconductive element drive motors for rotating the photoconductive elements 3*y*, 3*m*, 3*c*, and 3*bk*, a developing roller drive motor (not shown) for rotating the developing rollers 5*y*, 5*m*, 5*c*, and 5*bk* of the developing units 6*y*, 6*m*, 6*c*, and 6*bk*, respectively, a primary transfer belt drive motor (not shown) for rotating the intermediate transfer belt 12, and a fixing motor (not shown) for rotating the fixing members of the fixing unit 31.

When the states of the above-described motors become steady in their operations, the print controlling unit may turn on a power source for charging (not shown) that can apply respective charge biases to the respective charging rollers of the charging units 4*y*, 4*m*, 4*c*, and 4*bk* to turn on the respective charge biases.

In the exemplary embodiment of the present invention, a period of each of the above-described motors to reach the steady state can be set to 500 msec.

After the printer controller has turned on respective charge biases, the charging rollers of the charging units 4*y*, 4*m*, 4*c*, and 4*bk* may charge respective portions on the surfaces of the photoconductive elements 3*y*, 3*m*, 3*c*, and 3*bk* at respective charge applying positions. The charged portions on the surfaces of the photoconductive elements 3*y*, 3*m*, 3*c*, and 3*bk* may move to respective developing positions at which the developing rollers 5*y*, 5*m*, 5*c*, and 5*bk* of the developing units 6*y*, 6*m*, 6*c*, and 6*bk* may be held in contact with the photoconductive elements 3*y*, 3*m*, 3*c*, and 3*bk*.

In synchronization with the movement in which the charged portions of the photoconductive elements 3*y*, 3*m*, 3*c*, and 3*bk* reach the respective developing positions, the print controlling unit may turn on a power source for developing (not shown) that can apply respective development biases to the respective developing rollers 5*y*, 5*m*, 5*c*, and 5*bk* of the developing units 6*y*, 6*m*, 6*c*, and 6*bk* to turn on the respective development biases.

A period of time for which the charged portion of each of the photoconductive elements 3*y*, 3*m*, 3*c*, and 3*bk* moves from the charge applying portion to the developing portion can be obtained by dividing a distance between the charge applying portion and the developing portion by the linear velocity of the corresponding photoconductive element.

The print controlling unit may then operate a separation mechanism (not shown).

When an image to be printed is a black-and-white image, the printer controlling unit may cause the separation mechanism to contact the photoconductive element 3*bk* with the intermediate transfer belt 12 and to separate the photoconductive elements 3*y*, 3*m*, and 3*c* from the intermediate transfer belt 12. This is a first image forming condition.

When an image to be printed is a full color image, the print controlling unit may cause the separation mechanism to contact the photoconductive elements 3*y*, 3*m*, 3*c*, and 3*bk* with the intermediate transfer belt 12. This is a second image forming condition.

As the completion of the contact of the photoconductive elements 3*y*, 3*m*, 3*c*, and 3*bk* with the intermediate transfer belt 12 to provide the second image forming condition, the print controlling unit may cause a power source for primary transfer bias (not shown) to turn on respective transfer biases for the primary transfer rollers 13*y*, 13*m*, 13*c*, and 13*bk*.

With the above-described operation, the initiation of the printing operation can be completed.

Thus, the print controlling unit can determine each of the image forming operations and the image control is performed based on whether the first or second image forming condition is determined. The result of the above-described determination may be included into the "information" of operations during the image forming operation by the image forming mechanism 17 and during the image control by the image controlling mechanism 51.

Further, the print controlling unit can execute other controlling operations during the initiation of the printing operation. For example, the print controlling unit can execute an adjustment of phases between the photoconductive elements 3*y*, 3*m*, 3*c*, and 3*bk*, and a control of a charge alternating current (AC) of the above-described charge biases. In these cases, the print controlling unit may complete the above-described adjustment and control before starting an exposing operation for image forming.

After the initiation of the printing operation has been completed, the print controlling unit may cause the optical writing unit 8 to perform the exposing operation. In the exemplary embodiment of the present invention, an exposure start timing is referred to as a "F gate assert", and an exposure end timing is referred to as a "F gate negate."

The print controlling unit may determine before each exposing operation whether the next printing request has been issued, whether the image control in the continuous operation condition has been requested, or whether the CPU 52 has requested the image control in the changed operation condition.

When the next printing operation or the image control in the continuous operation condition has been requested, the print controlling unit may continue the image forming operations performed by the above-described image forming units, issue the F gate negate, wait for a predetermined period of time after the F gate negate, and issue the F gate assert signal again.

When (1) the next printing request has not been issued, (2) the image control in the continuous operation condition has not been requested, and (3) the image control in the changed operation condition has been requested, the print controlling unit may cause the various image forming components of the image forming units of the image forming mechanism 17 to stop the printing operation.

Next, other operations for executing the printing operation or the image control in the continuous operation condition during the printing operation are described.

When the printing operation is requested, the print controlling unit may cause one of the sheet feeding rollers 25 and 26 to feed the recording sheet S from the corresponding one of the sheet feeding cassettes 23 and 24 so that the recording sheet S can be conveyed to the pair of registration rollers 28 disposed downstream of the secondary transfer nip.

When the optical writing unit 8 exposes an image for printing, the print controlling unit may cause a power source for a secondary transfer bias (not shown) to turn on the secondary transfer bias before the F gate assert is issued.

In synchronization with the movement of an image formed on the surface of the intermediate transfer belt 12 to the secondary transfer nip, the print controlling unit may turn on a registration roller drive motor (not shown).

When (1) the printing operation is not requested during the printing operation, (2) the CPU 52 has not requested the image control in the continuous operation condition, or (3) the CPU 52 has requested the image control in the changed operation condition, the print controlling unit may not cause the recording sheet S to be fed from the sheet feeding cassettes 23 and 24.

Next, operations for completing or terminating the printing operation are described.

When (1) the printing operation is not requested, (2) the CPU 52 has not requested the image control in the continuous operation condition, or (3) the CPU 52 has requested the image control in the changed operation condition, the print controlling unit may control the various image forming components of the image forming units of the image forming mechanism 17 to complete or terminate the printing operation.

At the completion of the printing operation, the print controlling unit may cause the power source for the primary transfer biases to turn off the primary transfer biases. The print controlling unit may then turn on the power source for charging to turn off the respective charge biases. After a predetermined period of time has elapsed, the print controlling unit may turn off the power source for developing to turn off the respective development biases.

A period of time to turn off the developing bias can be obtained by dividing a distance on the surface of the photoconductive element between a contact portion with the charging roller and a contact portion with the developing roller by the linear velocity of the photoconductive element.

The print controlling unit may then turn on respective semiconductor laser dischargers (not shown) so that the semiconductor laser dischargers can emit respective laser light beams to discharge the electric charge from the photoconductive elements 3*y*, 3*m*, 3*c*, and 3*bk*.

After the semiconductor laser dischargers have completed the discharging operation for one cycle of the photoconductive elements 3*y*, 3*m*, 3*c*, and 3*bk*, the print controlling unit may turn off the photoconductive element drive motors, the developing roller drive motor, the primary transfer belt drive motor, and the fixing motor.

Next, the image control in the changed operation condition is described.

When a request of the image control in the changed operation condition is issued by the CPU 52 during the printing operation, the print controlling unit may execute the print completing operation according to the instructions by the CPU 52, as described above.

When the print completing operation is finished, the print controlling unit may start the initiation of the image control. The initiation of the image control may be performed in a same manner as the full color image forming operation.

Next, the adjustment of the photosensor unit 56, the image density control, and the image shift adjustment are described.

Firstly, the image control without the startup of components with respect to the adjustment of the photosensor unit 56, the image density control, and the image shift adjustment is described.

When the image density control and the image shift adjustment are requested and when the printing mode is set to the full color mode and a standard linear velocity mode, the CPU 52 may issue instructions to the print controlling unit to execute the image control in the continuous operation condition.

The "standard linear velocity mode" in the exemplary embodiment of the present invention is defined as a condition that a transfer sheet having a regularly used thickness is used and that a standard resolution is used for the exposing operation. The "standard resolution for the exposing operation" is a resolution that can resolve images without reducing the printing speed of the color printer 1 according to the exemplary embodiment of the present invention. Comprehensively, the standard linear velocity mode represents a mode that can obtain a satisfactory image quality in a less frequently used condition without reducing the linear velocity.

When the image control in the continuous operation condition is executed, the CPU 52 may store previously determined parameters used for the exposing operation into a storing unit (not shown) of the semiconductor laser controller, before the F gate assert that is a base time for starting the image control is issued. The parameters may include a position, size, and amount of exposure of a toner pattern for adjustment.

Figure 4:
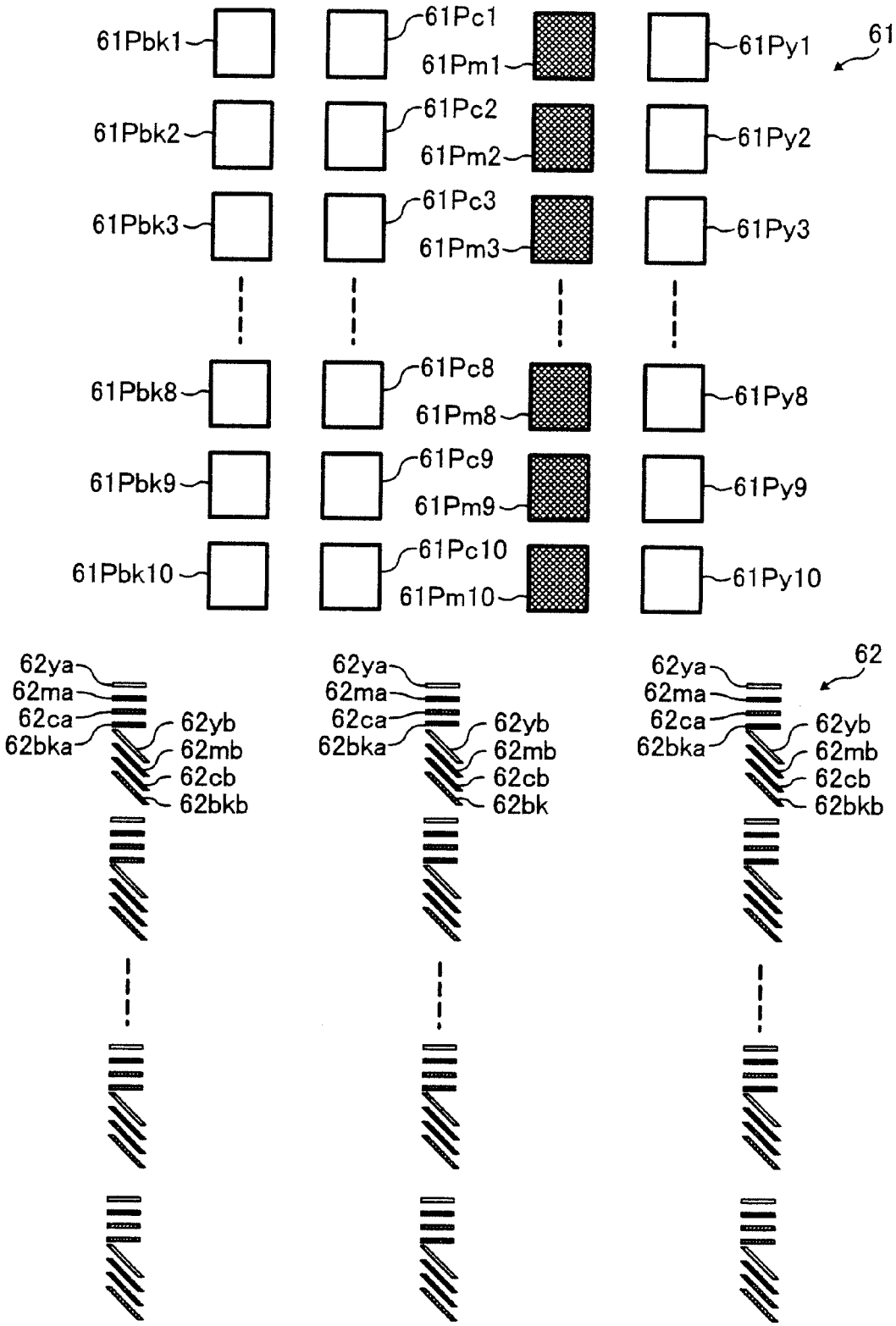
FIG. 4 is a drawing of toner patterns formed on an intermediate transfer belt provided to the color printer of FIG. 1.
Figure 5:
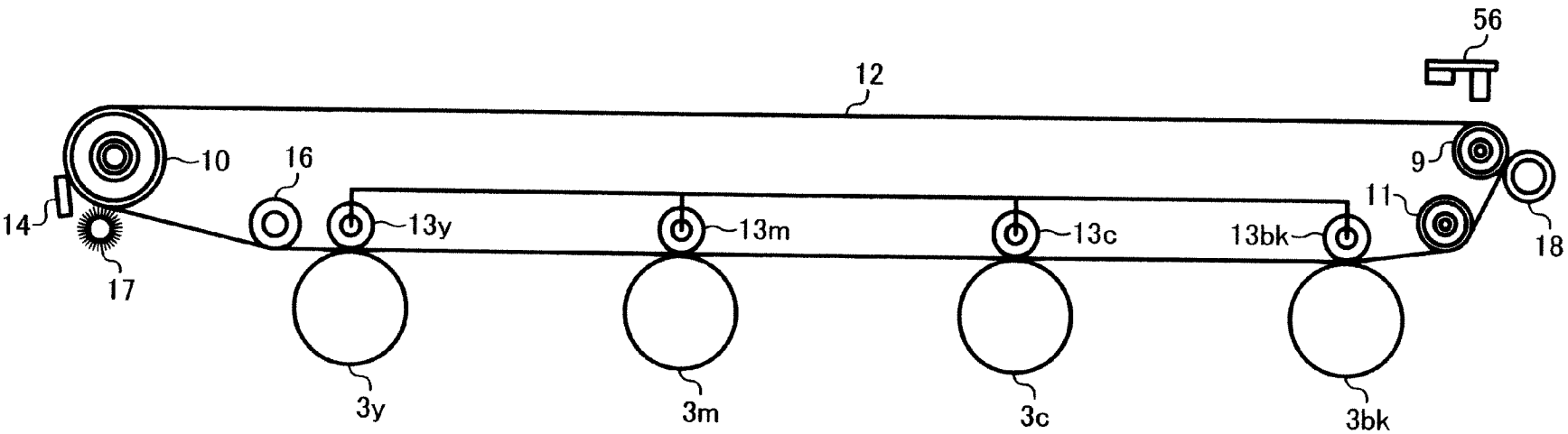
FIG. 5 is an enlarged view of a photosensor unit of the color printer of FIG. 1, with respect to the intermediate transfer belt of FIG. 4.

FIG. 4 shows the positions and sizes of toner patterns for the image control. FIG. 5 shows an enlarged view of a photosensor unit of the color printer 1 of FIG. 1.

As shown in FIG. 4, image density control toner patterns 61 and image shift adjustment toner patterns 62 are formed on the surface of the intermediate transfer belt 12. The image density control toner patterns 61 include 61Py1, 61Pm1, 61Pc1, 61Pbk1, 61Py2, 61Pm2, 61Pc2, 61Pbk2, 61Py3, 61Pm3, 61Pc3, 61Pbk3, . . . 61Py8, 61Pm8, 61Pc8, 61Pbk8, 61Py9, 61Pm9, 61Pc9, 61Pbk9, 61Py10, 61Pm10, 61Pc10, and 61Pbk10. The image shift adjustment toner patterns 62 include horizontal reference images 62*ya*, 62*ma*, 62*ca*, and 62*bka*, and oblique reference images 62*yb*, 62*mb*, 62*cb*, and 62*bkb*.

When the CPU 52 has issued instructions to the print controlling unit to form the image density control toner patterns 61 and the image shift adjustment toner patterns 62, the print controlling unit may form the toner patterns 61 and 62 on each image forming unit while continuing the operations of the photoconductive element drive motors, the developing roller drive motor, and the primary transfer belt drive motor.

In the image forming units of the image forming mechanism 17, the photoconductive elements 3*y*, 3*m*, 3*c*, and 3*bk* are rotated by the photoconductive element drive motors, then uniformly charged by the charging rollers of the charging units 4*y*, 4*m*, 4*c*, and 4*bk*, and exposed by the optical writing unit 8 so that the respective electrostatic latent images can be formed on the surfaces of the photoconductive elements 3*y*, 3*m*, 3*c*, and 3*bk*.

As previously described, the optical writing unit 8 may expose the toner patterns 61 and 62 according to the data of the previously determined parameters for performing the exposing operation. The parameters may include a position, size, and amount of exposure of a toner pattern for adjustment and be stored in the storing unit of the semiconductor laser controller.

These electrostatic latent images are developed by the developing units 6*y*, 6*m*, 6*c*, and 6*bk* to the yellow, magenta, cyan, and black toner patterns. The primary transfer rollers 13*y*, 13*m*, 13*c*, and 13*bk* may attract the toner patterns 61 and 62 having the above-described colors to transfer onto the surface of the intermediate transfer belt 12.

The print controlling unit may generate gradation of the image density control toner patterns 61. Specifically, the print controlling unit may control the power sources for charging and developing to change the charge bias and the development bias immediately before the respective exposed portions of the image control toner patterns 61 formed on the photoconductive elements 3*y*, 3*m*, 3*c*, and 3*bk* reach the corresponding developing positions between the photoconductive elements 3*y*, 3*m*, 3*c*, and 3*bk* and the developing units 6*y*, 6*m*, 6*c*, and 6*bk*.

Table 1 shows the conditions of the charge biases and the development biases with respect to 10 image density control toner patterns 61 shown in FIG. 4.

TABLE 1

| Toner Pattern No. | Charge Bias (−V) | Development Bias (−V) |
|---|---|---|
| 1 | 220 | 80 |
| 2 | 240 | 100 |
| 3 | 260 | 120 |
| 4 | 340 | 200 |
| 5 | 430 | 290 |
| 6 | 520 | 380 |
| 7 | 610 | 470 |
| 8 | 700 | 560 |
| 9 | 790 | 650 |
| 10 | 840 | 700 |

On starting the exposing operation of the image density control toner patterns 61, the CPU 52 may turn on the currents for a light emitting diode (LED) of the photosensor unit 56 and for the primary transfer bias. At this time, the current value of the LED of the photosensor unit 56 may be obtained from the adjustment of the photosensor unit 56, and the current value of the primary transfer bias may be the same value as a value used for the printing operation. The adjustment of the photosensor unit 56 will be described later.

The photosensor unit 56 may include a reflective light photosensor set that includes a light emitting element, which is a LED, and a light receiving element. As shown in FIG. 3, the photosensor unit 56 is disposed downstream of the secondary transfer nip. The photosensor unit 56 may detect the image density or amount of toner on the density control toner patterns 61 formed on the surface of the intermediate transfer belt 12, at a position on the outer surface of the intermediate transfer belt 12 supported by the supporting roller 9. After passing the photosensor unit 56, the image density control toner patterns 61 formed on the surface of the intermediate transfer belt 12 may be removed by the belt cleaning unit 14.

After the image density control toner patterns 61 have been developed, the print controlling unit may control the power sources for charging and developing to change the charge bias and the development bias to the same conditions as they were before forming the image density control toner patterns 61. That is, the charge bias and the development bias may be changed to the conditions used during or at the start of the previous printing operation.

The above-described changes may be performed because the image shift adjustment toner patterns 62 may not have density gradation for the image shift adjustment. Therefore, a solid image can be applied to the image shift adjustment toner patterns 62.

When the recording sheet S that has been conveyed for the previous printing operation passes the secondary transfer roller 18 while the image density control toner patterns 61 are being formed on the intermediate transfer belt 12, the print controlling unit may cause the separation mechanism to separate the sheet conveying belt 35 and the secondary transfer roller 18 from the intermediate transfer belt 12.

At this time, jitter may be generated on the image density control toner patterns 61 due to the change or fluctuation of the load acting on the image density control toner patterns 61 formed on the intermediate transfer belt 12. However, a relatively large number of points on the image density control toner patterns 61 may be sampled, so the jitter on the image density control toner patterns 61 may not adversely affect the detection of the image density.

After the image density control toner patterns 61 have been exposed and the sheet conveying belt 35 and the secondary transfer roller 18 have been separated, the optical writing unit 8 may start the exposing operation of the image shift adjustment toner patterns 62.

When performing the image density control and the image shift adjustment for the image control, the print controlling unit may start the formation of the image density control toner patterns 61 earlier than the formation of the image shift adjustment toner patterns 62. Thereby, the accuracy in controlling the operation of the image shift adjustment can be enhanced.

For performing the accurate detection and adjustment of the image shift, it is important to correctly form the image shift adjustment toner patterns 62 on the respective image forming positions on the intermediate transfer belt 12. Therefore, the image shift adjustment toner patterns 62 may be formed after the secondary transfer roller 18 has completely been separated from the intermediate transfer belt 12. By doing so, the toner patterns without jittering can be formed on the intermediate transfer belt 12.

As shown in FIG. 4, the image shift adjustment toner patterns 62 may be formed at the center and both sides of the intermediate transfer belt 12 in a main scanning direction or a width direction of the intermediate transfer belt 12. The images of the image shift adjustment toner patterns 62 may include the horizontal reference images 62*ya*, 62*ma*, 62*ca*, and 62*bka* and the oblique reference images 62*yb*, 62*mb*, 62*cb*, and 62*bkb* formed in a sub-scanning direction or a belt moving direction. The horizontal reference images 62*ya*, 62*ma*, 62*ca*, and 62*bka* and the oblique reference images 62*yb*, 62*mb*, 62*cb*, and 62*bkb* of the image shift adjustment toner patterns 62 are detected by the photosensor unit 56.

A group of the horizontal reference images 62*ya*, 62*ma*, 62*ca*, and 62*bka* and a group of the oblique reference images 62*yb*, 62*mb*, 62*cb*, and 62*bkb* are formed alternatively at predetermined intervals on the surface of the intermediate transfer belt 12. The horizontal reference images 62*ya*, 62*ma*, 62*ca*, and 62*bka* of the image shift adjustment toner patterns 62 have a predetermined width identical to each other, and are formed in parallel with each other along the width direction of the intermediate transfer belt 12. The oblique reference images 62*yb*, 62*mb*, 62*cb*, and 62*bkb* of the image shift adjustment toner patterns 62 also have a predetermined width identical to each other, and are formed in an oblique manner in the width direction of the intermediate transfer belt 12.

Next, the image control in the changed operation condition is described.

When the adjustment of the photosensor unit 56 is to be performed, the print controlling unit may complete the initiation of the image control for executing the image control in the changed operation condition, then execute the adjustment of the photosensor unit 56.

As previously described, the photosensor unit 56 may include the reflective light photosensor set. In this case, the type of the photosensor unit 56 may be an infrared specular reflection type.

Figure 6A:
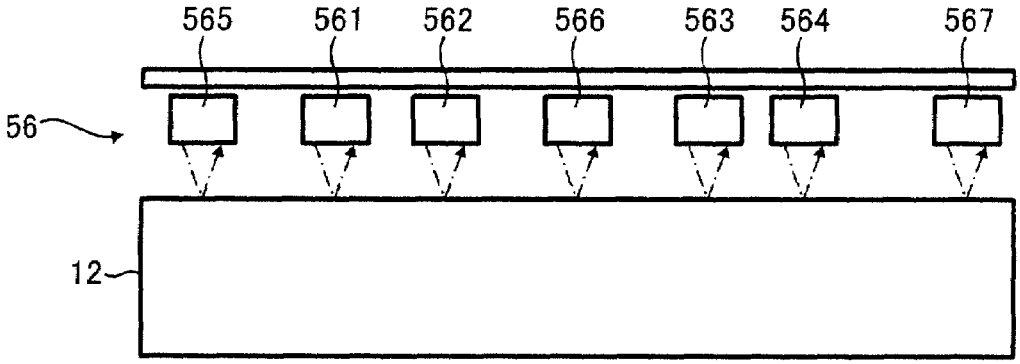
FIGS. 6A, 6B, and 6C are drawings of the intermediate transfer belt and the photosensor unit of FIG. 5, viewed from side, front, and bottom sides of the color printer of FIG. 1.
Figure 6B:
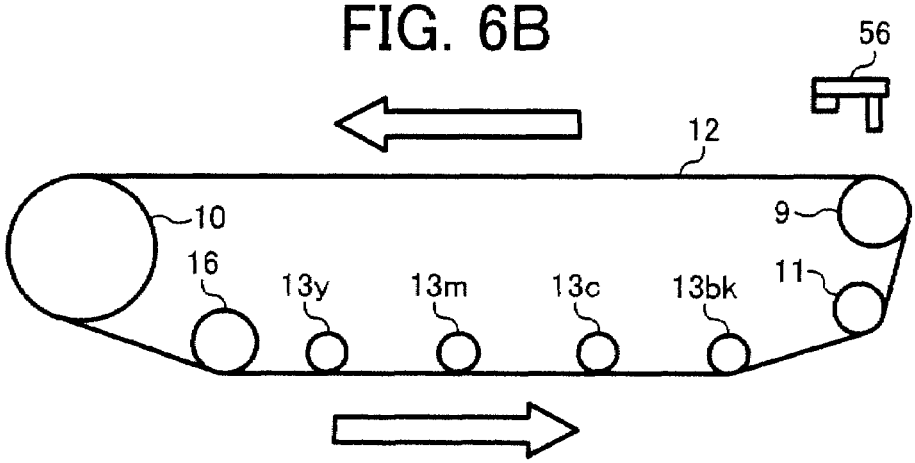
Figure 6C:
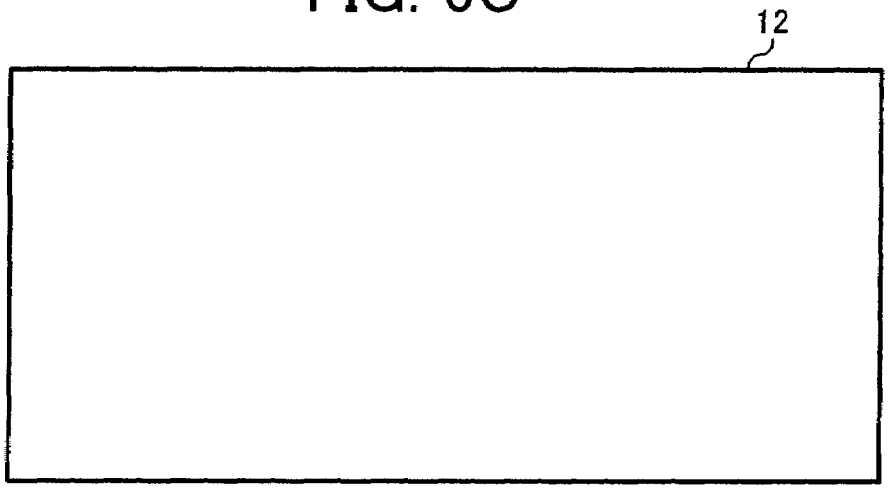

As shown in FIG. 6A, the photosensor unit 56 includes image density detection heads 561, 562, 563, and 564 and image shift detection heads 565, 566, and 567. As shown in FIGS. 6A through 6C, the image density detection heads 561, 562, 563, and 564 and the image shift detection heads 565, 566, and 567 of the photosensor unit 56 are mounted on a same substrate of the photosensor unit 56 and are disposed facing the outer surface of the intermediate transfer belt 12 in the substantially vertical direction with respect to the intermediate transfer belt 12.

In the exemplary embodiment of the present invention, the image density detection heads 561, 562, 563, and 564 and the image shift detection heads 565, 566, and 567 of the photosensor unit 56 are separately provided to detect the image density control toner patterns 61 and the image shift adjustment toner patterns 62, respectively. However, detection heads are not limited to the above-described detection heads 561 through 567. For example, a detection head that can detect both the image density and the image shift can be applied to the present invention. In this case, a group of the image density control toner patterns 61 and a group of the image shift adjustment toner patterns 62 may be alternatively formed on the surface of the intermediate transfer belt 12, in a same line in the belt moving direction of the intermediate transfer belt 12.

After starting the adjustment of the photosensor unit 56 according to the instructions of the CPU 52, the print controlling unit may turn on the LED current of the photosensor unit 56. The value of the LED current may be retrieved from the RAM 54, in which the value is stored. When the LED current of the photosensor unit 56 turns on, the CPU 52 may wait for approximately 2 to 3 seconds until the state of the LED current may be stabilized and may read output signals detected by the photosensor unit 56 via the A/D converter circuits 59 and 60.

The CPU 52 may read the output signals of the photosensor unit 56 under the condition of reading 100 points at intervals of 4 msec. That is, when the linear velocity of the intermediate transfer belt 12 is approximately 150 mm/sec, the photosensor unit 56 can read data along a length of approximately 60 mm on the intermediate transfer belt 12.

The readout values to read the output signals may be decided through tests according to the levels of dispersion of reflectance on the intermediate transfer belt 12, so as to obtain a more precise reflectance therefrom.

The CPU 52 may obtain an average value "Vs" of the above-described readout values.

After obtaining the average value "Vs", the CPU 52 performs a binary search to find a LED current satisfying a relationship of "Vs=4.0V." By storing the LED current satisfying the relationship of "Vs=4.0V" into the RAM 54 of the controller 55, the CPU 52 may adjust the photosensor unit 56.

After the adjustment of the photosensor unit 56 has been completed, the print controlling unit may form the image density control toner patterns 61 and the image shift adjustment toner patterns 62 in the same procedure as performed for the image control in the continuous operation condition.

The following procedures may be applied for both the image control in the changed operation condition and the image control in the continuous operation condition.

After passing the secondary transfer nip, the image density control toner patterns 61 and the image shift adjustment toner patterns 62 formed on the intermediate transfer belt 12 may be read by the photosensor unit 56.

After the photosensor unit 56 has read the image density control toner patterns 61 and the image shift adjustment toner patterns 62, the image density controlling portion 59 and the image shift adjusting portion 60 may be requested to provide different accuracies of A/D conversion and different processing. Therefore, the image density controlling portion 59 and the image shift adjusting portion 60 may, hereinafter, separately perform their operations.

In the image density controlling portion 59, the A/D converter circuit 57 may convert the readout output signals of the photosensor unit 56. The CPU 52 may then calculate and obtain an amount of toner on each of the respective reference images based on the converted readout output signals.

For calculating the amount of toner on an image, the CPU 52 may obtain a normalized value "N" from the following equation:

$$N=(Vsp-Voffset)/(Vsg-Voffset),$$

in which "Vsg" represents a readout voltage on a reference surface or a ground surface of the intermediate transfer belt 12, "Voffset" represents a sensor offset voltage, and "Vsp[n]" represents a pattern voltage or a reference image voltage.

For calculating respective amounts of color toners, a saturation power voltage may depend on the parameters of the image density detection heads 561 through 564 of the photosensor unit 56, for example, the diameter and color of a toner particle, the spectral sensitivity and detection angle of each head, and so forth. Therefore, a reference board may be applied to each apparatus for the image density detection heads 561 through 564 of the photosensor unit 56 of a specular reflection type and/or toner may be sufficiently adhered onto the photoconductive elements 3*y*, 3*m*, 3*c*, and 3*bk*. By doing so, the saturation power voltage of each apparatus can be detected.

After the saturation power voltage has been detected, the CPU 52 may obtain the normalized value "N" from the following equation:

$$N=(Vsp-Vmin)/(Vsg-Vmin),$$

in which "Vmin" represents the saturation power voltage.

With the normalized value "N" obtained as described above, the accuracy in detection of the amount of toner may further increase.

Further, the color toners may have a characteristic in which an amount of diffuse reflection with respect to an image may increase in proportion to an increase of the amount of toner on the photoconductive elements 3*y*, 3*m*, 3*c*, and 3*bk*. According to the above-described characteristic of the color toner, the image density detection heads 561 through 564 of the photosensor unit 56 may be a diffuse reflection type.

Since the normalization value "N" can reduce the dispersion of each apparatus, the CPU 52 can estimate an amount of toner on each toner pattern. The amount of toner is represented as "M/A." The CPU 52 may estimate the amount of toner according to the output characteristics of the photosensor unit 56, which have been obtained based on the normalization value "N" and the amount of toner "M/A" on the photoconductive elements 3*y*, 3*m*, 3*c*, and 3*bk*. For the estimation or conversion of the amount of toner "M/A" on each toner pattern, a look up table (LUT), an approximate expression, and so forth may be used.

The CPU 52 may then obtain an image forming condition according to a relationship of the amount of toner "M/A" on each toner pattern and the development bias, which is one of the image forming conditions. Since the development bias and the amount of toner "M/A" change substantially in proportion to each other, the CPU 52 may use the least-squares method so as to obtain a primary approximate expression. The amount of toner "M/A" and the image density may also change substantially in proportion to each other in a predetermined range used for the image forming operation. That is, when the amount of toner "M/A" is maintained in a constant state, the image density may also be stabilized.

Consequently, the CPU 52 may obtain the development bias from a target amount of toner "M/A", which has been obtained through tests for regulating the image density, and an approximate straight line, which is the primary approximate expression.

After the development bias has been obtained, the CPU 52 may then obtain the charge bias. The CPU 52 may obtain the charge bias according to the expression that satisfies a relationship of "Charge Bias=Development Bias+140V."

The CPU 52 may store the obtained charge bias and the development bias into the RAM 54 of the controller 55, so that these charge bias and development bias may be set to the respective values for the next printing operation.

Next, operations of the image shift adjustment are described.

The A/D converter circuit 58 of the image shift adjusting portion 60 may perform the A/D conversion with respect to the output voltage value of the image shift detection heads 565, 566, and 567 of the photosensor unit 56. By doing so, a relationship of the detection time and the output voltage of the photosensor unit 56 may be obtained.

The CPU 52 may detect an output voltage "Vline" of the A/D converter circuit 58 by a cycle of 20 KHz so as to obtain a time "Tf" that satisfies a relationship of "Vline<2.0V." The CPU 52 may store the time "Tf" into the RAM 54 of the controller 55.

The CPU 52 may then obtain a time "Tr" that satisfies a relationship of "Vline>2.0V", and store the time "Tr" into the RAM 54 of the controller 55.

The CPU 52 may obtain a sensor passing time "Tc" from an equation satisfying a relationship of "Tc=(Tr+Tf)/2." The sensor passing time "Tc" is a time of which a toner pattern of a target color passes the corresponding detection head of the photosensor unit 56.

The CPU 52 may repeat the above-described operation for obtaining the time "Tc" for each color. For example, the sensor passing times "Tc" for the yellow, magenta, cyan, and black colors may be represented as "Tc[y]", "Tc[m]", "Tc[c]", and "Tc[bk]", respectively.

After the respective sensor passing times "Tc[y]", "Tc[m]", "Tc[c]", and "Tc[bk]" have been obtained, the CPU 52 may obtain each relative time difference "Td" based on the sensor passing times "Tc[y]", "Tc[m]", and "Tc[c]", and "Tc[bk]." For example, the relative time difference "Td[c]" between the black and cyan colors may be obtained based on the expression of "Td=Tc[bk]−Tc[c]." The time differences "Td" for the sensor passing times "Tc[y]" for yellow color, "Tc[m]" for magenta color, "Tc[c]" for cyan color, and "Tc [bk]" for black color may be represented as "Td[y]", "Td[m]", "Td[c]", and "Td[bk]", respectively.

After the time differences "Td[y]", "Td[m]", "Td[c]", and "Td[bk]" have been obtained, the CPU 52 may store data of the time differences "Td[y]", "Td[m]", "Td[c]", and "Td [bk]" into the RAM 54 of the controller 55. By adding the time difference "Td" of each color to the start timing of the exposing operation by the optical writing unit 8 for the next printing operation, the image shift in a moving direction of the photoconductive elements 3*y*, 3*m*, 3*c*, and 3*bk* may be adjusted.

In the exemplary embodiment of the present invention, the image shift adjustment in the moving direction of the photoconductive elements 3*y*, 3*m*, 3*c*, and 3*bk* has been described. However, a photosensor mounted in a direction perpendicular to the moving direction of the photoconductive elements 3*y*, 3*m*, 3*c*, and 3*bk*, or an axial direction thereof, may be applied to the present invention. With such a structure having the above-described photosensor, the CPU 52 may obtain the difference of the times of the toner patterns 61 and 62 passing the photosensor unit 56, so that the image shift at a relative position in the direction perpendicular to the moving direction of the photoconductive elements 3*y*, 3*m*, 3*c*, and 3*bk* or the axial direction thereof, can also be adjusted.

According to the above-described exemplary embodiment of the present invention, when the image control is performed during the printing operation in which the image is transferred onto the recording sheet S, the operation condition of starting the image control may be determined according to information of operations during the printing operation by the image forming mechanism 17 and information of operations during the image control by the CPU 52 of the image controlling mechanism 51. Thereby, both the system stopping period and the damage to the color printer 1 can be reduced.

According to the above-described exemplary embodiment of the present invention, the operation condition of starting the image control may include the image control with the changed operation condition and the image control with the continuous operation condition. Specifically, when the respective linear velocities of the photoconductive elements 3*y*, 3*m*, 3*c*, and 3*bk* during the printing operation are the same as the respective linear velocities of the photoconductive elements 3*y*, 3*m*, 3*c*, and 3*bk* during the image control, the image control with the continuous operation condition may be performed. When the respective linear velocities of the photoconductive elements 3*y*, 3*m*, 3*c*, and 3*bk* during the printing operation are different from the respective linear velocities of the photoconductive elements 3*y*, 3*m*, 3*c*, and 3*bk* during the image control, the image control with the changed operation condition may be performed. Thereby, both the system stopping period and the damage to the color printer 1 can be reduced.

According to the above-described exemplary embodiment of the present invention, the print controlling unit may cause the separation mechanism to contact the photoconductive element 3*bk* with the intermediate transfer belt 12 and to separate the photoconductive elements 3*y*, 3*m*, and 3*c* from the intermediate transfer belt 12, so as to form the first image forming condition when a black-and-white image is to be printed, and may cause the separation mechanism to contact the photoconductive elements 3*y*, 3*m*, 3*c*, and 3*bk* with the intermediate transfer belt 12, so as to form the second image forming condition when a full color image is to be printed. Further, the information of operations during the printing operation by the image forming mechanism 17 and the information of operations during the image control by the CPU 52 of the image controlling mechanism 51 may include information as a result of determining whether each of the image forming operation and the image control is performed with the first or second image forming condition. Thereby, both the system stopping period and the damage to the color printer 1 can be reduced.

In another exemplary embodiment of the present invention, the CPU 52 of the image controlling mechanism 51 may perform the image control at a predetermined single linear velocity with respect to the photoconductive elements 3*y*, 3*m*, 3*c*, and 3*bk* and the intermediate transfer belt 12. Thereby, the system stopping period of the color printer 1 can be reduced and the accuracy in controlling the color printer 1 can be enhanced.

In another exemplary embodiment of the present invention, the CPU 52 of the image controlling mechanism 51 may perform the image control at a fastest linear velocity in the color printer 1. Thereby, the system stopping period of the color printer 1 can be reduced and the accuracy in controlling the color printer 1 can be enhanced.

In another exemplary embodiment of the present invention, the CPU 52 of the image controlling mechanism 51 may perform the image control at a most frequently used linear velocity in the color printer 1. Thereby, the system stopping period of the color printer 1 can be reduced and the accuracy in controlling the color printer 1 can be enhanced.

In another exemplary embodiment of the present invention, the CPU 52 of the image controlling mechanism 51 may perform the image control under the second image forming condition. Thereby, the system stopping period of the color printer 1 can be reduced.

According to at least one above-described exemplary embodiment of the present invention, the CPU 52 of the image controlling mechanism 51 may perform at least one of the image density control and the image shift adjustment, and the image density control is started before the image shift adjustment. Thereby, the accuracy in controlling the operation of the image shift adjustment can be enhanced.

According to at least one above-described exemplary embodiment of the present invention, the CPU 52 of the image controlling mechanism 51 may perform the adjustment of the photosensor unit 56, the photosensor unit 56 may perform one of the image density control and the image shift adjustment, and the type of the image control may indicate the adjustment of the photosensor unit 56. Thereby, the accuracy in adjusting the photosensor unit 56 can be enhanced.

The above-described example embodiments are illustrative, and numerous additional modifications and variations are possible in light of the above teachings. For example, elements and/or features of different illustrative and exemplary embodiments herein may be combined with each other and/or substituted for each other within the scope of this disclosure and appended claims. It is therefore to be understood that within the scope of the appended claims, the disclosure of this patent specification may be practiced otherwise than as specifically described herein.

Obviously, numerous modifications and variations of the present invention are possible in light of the above teachings. It is therefore to be understood that within the scope of the appended claims, the invention may be practiced otherwise than as specifically described herein.

The invention claimed is:

1. An image forming apparatus, comprising:

an image bearing member;

an image forming mechanism configured to perform an image formation by performing a first image forming operation to form a first image on a surface of the image bearing member and an image transferring operation to transfer the first image onto a recording member; and an image quality controlling mechanism configured to perform an image control by performing a second image forming operation to form a second image on the surface of the image bearing member and an image controlling operation to control an image quality according to the second image, the image quality controlling mechanism determining an operation condition of starting the image control according to first information of operations during the image formation by the image forming mechanism and second information of operations during the image control by the image quality controlling mechanism, when the second image forming operation is performed during the first image forming operation.

2. The image forming apparatus according to claim 1, wherein:

the first information and the second information include respective linear velocities of the image bearing member during the image formation and the image control.

3. The image forming apparatus according to claim 1, wherein:

the image bearing member includes:

a plurality of primary image bearing members, each of which is configured to bear one of the first and second images, and a secondary image bearing member configured to receive the one of the first and second images from the plurality of primary image bearing members;

the first and second image forming operations include:

a first image forming condition in which only one of the plurality of primary image bearing members is held in contact with the secondary image bearing member, and a second image forming condition in which the plurality of primary image bearing members are held in contact with the secondary image bearing member; and the first information of operations during the image formation by the image forming mechanism and the second information of operations during the image control by the image quality controlling mechanism include information as a result of determining whether each of the image formation and the image control is performed with the first or second image forming condition.

4. The image forming apparatus according to claim 1, wherein:

the image quality controlling mechanism performs the image control at a predetermined single linear velocity of the image bearing member.

5. The image forming apparatus according to claim 1, wherein:

the image quality controlling mechanism performs the image control at a fastest linear velocity in the image forming apparatus.

6. The image forming apparatus according to claim 1, wherein:

the image quality controlling mechanism performs the image control at a most frequently used linear velocity of the image forming apparatus.

7. The image forming apparatus according to claim 3, wherein:

the image quality controlling mechanism performs the image control under the second image forming condition.

8. The image forming apparatus according to claim 3, wherein:

the image control includes an image density control and an image shift adjustment, the image quality controlling mechanism performs at least one of the image density control and the image shift adjustment, and the image density control is started before the image shift adjustment.

9. The image forming apparatus according to claim 1, wherein:

the image quality controlling mechanism further determines the operation condition of starting the image control according to the first information, the second information, and third information of a type of the image control.

10. The image forming apparatus according to claim 9, further comprising:

a sensor configured to detect the second image.

11. The image forming apparatus according to claim 10, wherein:

the image quality controlling mechanism performs an adjustment of the sensor, the image control includes an image density control and an image shift adjustment, the sensor performs one of the image density control and the image shift adjustment, and the third information includes information indicating that the adjustment of the sensor is performed.

12. An image forming apparatus, comprising:

means for bearing an image including a first image and a second image;

first means for performing an image formation, the first means for performing including:

first means for forming the first image on a surface of the means for bearing, and means for transferring the first image onto a recording member; and second means for performing an image control, the second means for performing including:

second means for forming the second image on the surface of the means for bearing, and means for controlling an image quality according to the second image, wherein the second means for performing determines an operation condition of starting the image control according to first information of operations during the image formation by the first means for performing and second information of operations during the image control by the second means for performing, when the second means for forming forms the second image while the first means for forming forms the first image.

13. The image forming apparatus according to claim 12, wherein:

the first information and the second information include respective linear velocities of the means for bearing during the image formation and the image control.

14. The image forming apparatus according to claim 12, wherein:

the means for bearing includes:

means for carrying one of the first and second images, and means for receiving the one of the first and second images from the means for carrying;

the first and second means for performing include:

a first image forming condition in which only the means for carrying is held in contact with the means for receiving so that a monochrome image is formed, and a second image forming condition in which the means for carrying is held in contact with the means for receiving so that a color image is formed; and the first information of operations during the image formation and the second information of operations during the image control include information as a result of determining whether each of the image formation and the image control is performed with the first or second image forming condition.

15. The image forming apparatus according to claim 14, wherein:

the second means for performing forms the second image control under the second image forming condition.

16. The image forming apparatus according to claim 14, wherein:

the image control includes an image density control and an image shift adjustment, the second means for performing performs at least one of the image density control and the image shift adjustment, and the image density control is started before the image shift adjustment.

17. The image forming apparatus according to claim 12, wherein:

the second means for performing further determines the operation condition of starting the image control according to the first information, the second information, and third information of a type of the image control.

18. The image forming apparatus according to claim 17, further comprising:

means for detecting the second image, wherein the second means for performing performs an adjustment of the sensor, wherein the image control includes an image density control and an image shift adjustment, wherein the means for detecting performs one of the image density control and the image shift adjustment, and wherein the third information includes information indicating that the adjustment of the sensor is performed.

19. A method of controlling an image quality, comprising:

performing an image formation by forming a first image on an image bearing member;

performing an image control by forming a second image on the image bearing; and determining an operation condition of starting the image control according to first information of operations during the image formation and second information of operations during the image control, when the image control is performed during the image formation.

20. The method of controlling the image quality according to claim 19, wherein:

the determining further includes:

determining an execution timing of an image control;

determining a type of the image control;

determining at least one printing mode; and determining the operation condition of starting the image control.

* * * * *